US008465124B2

(12) United States Patent
Hanaoka et al.

(10) Patent No.: US 8,465,124 B2
(45) Date of Patent: Jun. 18, 2013

(54) CARRIAGE GUIDE MECHANISM AND A PRINTER

(75) Inventors: Yukihiro Hanaoka, Shiojiri (JP); Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 13/013,750

(22) Filed: Jan. 25, 2011

(65) Prior Publication Data

US 2011/0181661 A1 Jul. 28, 2011

(30) Foreign Application Priority Data

Jan. 26, 2010 (JP) ..... 2010-013932

(51) Int. Cl.
*B41J 23/00* (2006.01)
*B41J 1/36* (2006.01)
*B41J 25/304* (2006.01)

(52) U.S. Cl.
USPC ..... 347/37

(58) Field of Classification Search
USPC ..... 347/37
See application file for complete search history.

(56) References Cited

U.S. PATENT DOCUMENTS 3,643,242 A * 2/1972 Bryer ..... 360/78.12
3,998,497 A * 12/1976 Koizumi ..... 384/53
4,012,778 A * 3/1977 Johnson ..... 360/78.12
4,375,195 A * 3/1983 Tsuboi ..... 104/246
5,831,962 A * 11/1998 Sakai et al. ..... 720/672
5,867,188 A * 2/1999 Murayama et al. ..... 347/37
6,932,457 B2 * 8/2005 Sato ..... 347/37
7,390,077 B2 6/2008 Miyazaki et al.

FOREIGN PATENT DOCUMENTS

CN 1890109 A 1/2007
EP 1 666 268 A1 6/2006
JP 2006-123456 A 5/2006

* cited by examiner

*Primary Examiner* — Matthew Luu
*Assistant Examiner* — Alexander D Shenderov
(74) *Attorney, Agent, or Firm* — Kilpatrick Townsend & Stockton LLP

(57) ABSTRACT

A carriage guide mechanism for a printer enables using plural rolling bearings to move a carriage along a guide shaft with no play or vibration. The carriage bearing units of the printer carriage guide mechanism have three rolling bearings each that hold the guide shaft from three directions. The outer ring of each rolling bearing makes line contact with the outer ring roller surfaces, which each face a different direction and are formed on the guide plate of the guide shaft, and contact therebetween is maintained by the urging force of a flat spring. Because chatter and vibration, particularly play and vibration around the center axis of the guide shaft, can be prevented when the carriage moves, a drop in print quality due to vibration of the printhead caused by carriage chatter or vibration can be reliably prevented.

3 Claims, 6 Drawing Sheets

CARRIAGE GUIDE MECHANISM AND A PRINTER

This application claims priority to Japanese Patent Application No. 2010-013932, filed Jan. 26, 2010, the entirety of which is incorporated by reference herein.

BACKGROUND

1. Technical Field

The invention relates to a carriage guide mechanism that is used in a printer to guide a carriage that carries a printhead in a main scanning direction perpendicular to the recording paper transportation direction. More particularly, the invention relates to a carriage guide mechanism that is used in a printer to guide a carriage with no play or vibration.

2. Related Art

Serial printers such as roll paper printers used to issue receipts and print journal reports move a carriage bidirectionally in a main scanning direction that is perpendicular to the recording paper transportation direction while simultaneously driving a printhead that is carried on the carriage to print on the recording paper. If there is a gap between the carriage and the guide shaft that guides the carriage in the main scanning direction, there is some play in the carriage when the carriage is moved, resulting in vibration or chatter that renders the printing position on the recording paper of the printhead carried on the carriage unstable and results in such problems as a drop in print quality. Particularly when an inkjet head is used, this causes the position where the ink droplets discharged to the recording paper and to become unstable and easily results in a drop in print quality.

To solve this problem, the recording device taught in Japanese Unexamined Patent Appl. Pub. JP-A-H04-347676 eliminates play between the carriage guide shaft and the carriage by supporting the carriage guide shaft by means of a bearing that combines a rolling bearing and a sliding bearing.

The inkjet printer taught in Japanese Unexamined Patent Appl. Pub. JP-A-2006-123456 prevents play between the carriage and a guide rail by holding a guide rail (guide shaft) from three directions by means of a bearing attached to the carriage.

With the carriage guide mechanism that uses a rolling bearing to guide the carriage as taught in the related art, the guide shaft is circular in section, and the outer ring of the rolling bearing attached to the carriage makes point contact with the circular outside surface of the guide shaft. With this configuration the carriage moves while the rolling bearing rolls along the round outside surface of the guide shaft. If the rolling bearing is disposed to hold the outside circumference of the guide shaft from plural directions, such as from three directions, play and vibration of the carriage in directions separating away from the guide shaft can be reliably prevented. However, play and vibration in the direction in which the carriage pivots on the round guide shaft cannot be effectively suppressed. Particularly if the guide shaft is slender in the direction perpendicular to the direction of carriage movement (that is, the recording paper transportation direction), movement of the carriage around the axis of the guide shaft is amplified with distance and is particularly great at the parts of the carriage farthest from the guide shaft. As a result, the position of the printhead carried on the carriage varies relative to the recording paper, the platen gap may vary greatly in the ink nozzle row direction in the case of an inkjet head, and print quality may drop.

SUMMARY

A carriage guide mechanism according to the invention uses a plurality of rolling bearings to support a carriage on a guide shaft with no play or vibration. Another aspect of the invention is a printer that uses this carriage guide mechanism A first aspect of the invention is a carriage guide mechanism that guides a carriage carrying a printhead in a main scanning direction perpendicular to the recording paper transportation direction, the carriage guide mechanism including: a guide shaft that extends in the main scanning direction; and at least three rolling bearings that support the carriage freely movably on the guide shaft. At least three outer ring roller surfaces that extend in the direction of the center axis of the guide shaft are formed to the outside surface of the guide shaft, each of the outer ring roller surfaces facing a different direction, and the number of outer ring roller surfaces and the number of rolling bearings are set so that at least one rolling bearing is opposite each outer ring roller surface. Each rolling bearing includes an inner ring support shaft attached to the carriage, an inner ring affixed coaxially to the inner ring support shaft, an outer ring coaxially disposed around the inner ring, and a plurality of rollers inserted to roll freely in an annular track formed between the inner ring and the outer ring. The outer ring of each rolling bearing contacts the outer ring roller surface so that the rolling bearings can roll axially to the guide shaft along the outer ring roller surface opposing the rolling bearing.

Instead of using a guide shaft with a circular section such as commonly used as a guide shaft, the invention uses a bearing structure that uses a guide shaft having outer ring roller surfaces extending along the axis of the guide shaft, forms the outer ring roller surfaces at plural locations around the outside surface of the guide shaft so that each outer ring roller surface faces a different direction, and sets the outer ring of rolling bearings on the carriage side in contact with the outer ring roller surfaces. Because the carriage is supported on the guide shaft by plural rolling bearings, both vertical and horizontal play and vibration can be eliminated in the carriage. In addition, the outer rings of the rolling bearings make line contact with the outer ring roller surfaces in different directions around the guide shaft. Chatter and vibration of the carriage around the axis of the guide shaft can therefore also be reliably prevented.

In order to more reliably prevent carriage chatter and vibration, at least a first outer ring roller surface, a second outer ring roller surface perpendicular to the first outer ring roller surface, and a third outer ring roller surface that is inclined at an angle of less than 90 degrees to the first and second outer ring roller surfaces are formed as outer ring roller surfaces, and a specific urging force is applied to the inner ring support shaft of the rolling bearing opposite the third outer ring roller surface to urge the outer ring of the rolling bearing to the third outer ring roller surface. This urging force holds the outer rings of the corresponding rolling bearings in contact with the other outer ring roller surfaces.

While a guide shaft with a polygonal section could be used as the guide shaft with outer ring roller surfaces, due to manufacturability and weight reduction considerations, a guide shaft that has a main guide shaft that is round in section, and a tubular guide panel that is disposed to the main guide shaft so that the guide panel surrounds the round outside surface of the main guide shaft, is preferable. In this configuration, at least three flat parts where the outer ring roller surfaces are formed are rendered in the outside surface of the guide panel, and the inside surfaces of the flat parts contact the round outside surface of the main guide shaft.

When the guide shaft is thus rendered by a main guide shaft and a guide panel, the gap that is formed between the outside surface of the main guide shaft and the inside surface of the guide panel can be used a grease reservoir to lubricate the rolling bearings.

In order to reliably prevent sideways chatter and vibration in the carriage centered on a position on the guide shaft side on a plane including the axial center of the guide shaft, the carriage is preferably supported on the guide shaft by plural rolling bearings at both ends of the carriage in the main scanning direction. More specifically, one rolling bearing opposite the first outer ring roller surface, and one rolling bearing opposite the second outer ring roller surface, are preferably disposed at both ends of the carriage in the main scanning direction. Alternatively, three rolling bearings can obviously be disposed opposing the first to third outer ring roller surfaces on both ends.

A printer according to another aspect of the invention has the carriage guide mechanism described above.

EFFECT OF THE INVENTION

The carriage guide mechanism according to the invention sets the outer rings of rolling bearings on the carriage side in line contact with outer ring roller surfaces formed at plural places around the outside of the guide shaft. Chatter and vibration of the carriage in each direction can thus be effectively prevented. The printer according to the invention can therefore reliably prevent a drop in print quality caused by play and vibration during carriage movement.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet roll paper printer according to the present invention is described below with reference to the accompanying figures.

General Configuration of a Roll Paper Printer

Figure 1:
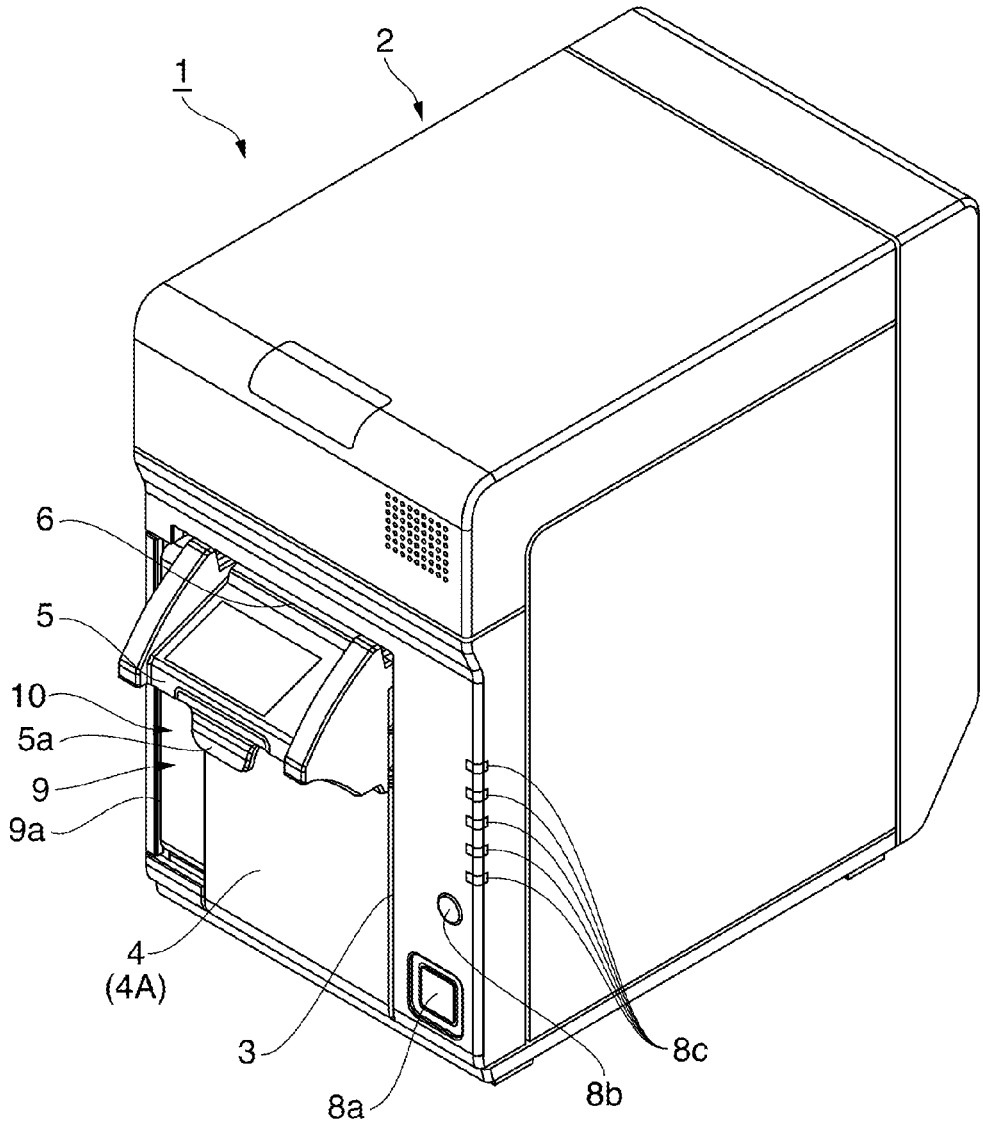
FIG. 1 is an external oblique view of a roll paper printer according to the invention.
Figure 2:
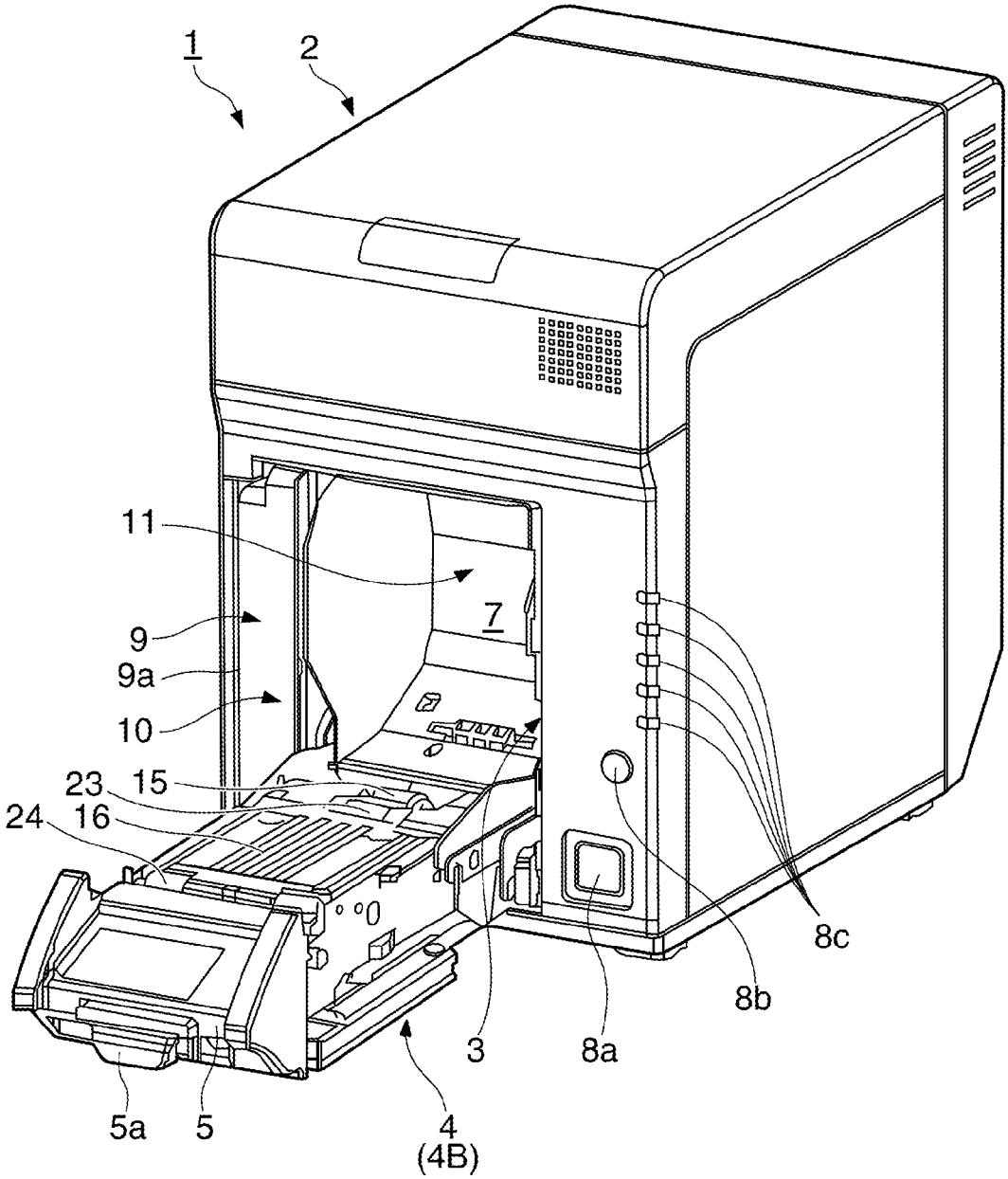
FIG. 2 is an external oblique view showing the roll paper printer with the cover open.

FIG. 1 is an external oblique view of a roll paper printer according to this embodiment of the invention, and FIG. 2 is an external oblique view showing the roll paper printer with the cover open. The roll paper printer 1 shown in the figures uses plural colors of ink to print in color on a web of recording paper that is delivered from a paper roll. The roll paper printer 1 has a generally box-shaped printer case 2 with an opening 3 in the middle front part of the printer case 2 for loading roll paper. An access cover 4 is disposed to the opening 3, and a recording paper discharge guide 5 is disposed at the top end of the cover 4. A recording paper exit 6 is formed between the discharge guide 5 and the top edge of the opening 3 in the printer case 2.

An operating tab 5*a* is attached protruding down from a position in the widthwise center of the printer at the front bottom side of the recording paper discharge guide 5. When this operating tab 5*a* is pulled to the front of the printer, the operating tab 5*a* rotates forward and disengages a lock not shown so that the cover 4 can be opened to the front of the printer. When the operating tab 5*a* is pulled further forward from this position, the access cover 4 can open from the closed position 4A shown in FIG. 1 and pivot forward on the bottom end thereof to the open position 4B shown in FIG. 2. When the cover 4 is open, the roll paper compartment 7 formed inside the roll paper printer 1 is open, and the roll paper can be loaded or replaced.

A power switch 8*a*, paper feed switch 8*b*, and a plurality of operating indicators 8*c* are disposed in the front of the printer case 2 on the right side of the access cover 4. An opening 9*a* to the ink cartridge loading unit 9, which is rectangular in section and is long in the front-back direction of the printer, is rendered in the front of the printer case 2 on the left side of the cover 4, and an ink cartridge 10 is loaded in this ink cartridge loading unit 9.

Figure 3:
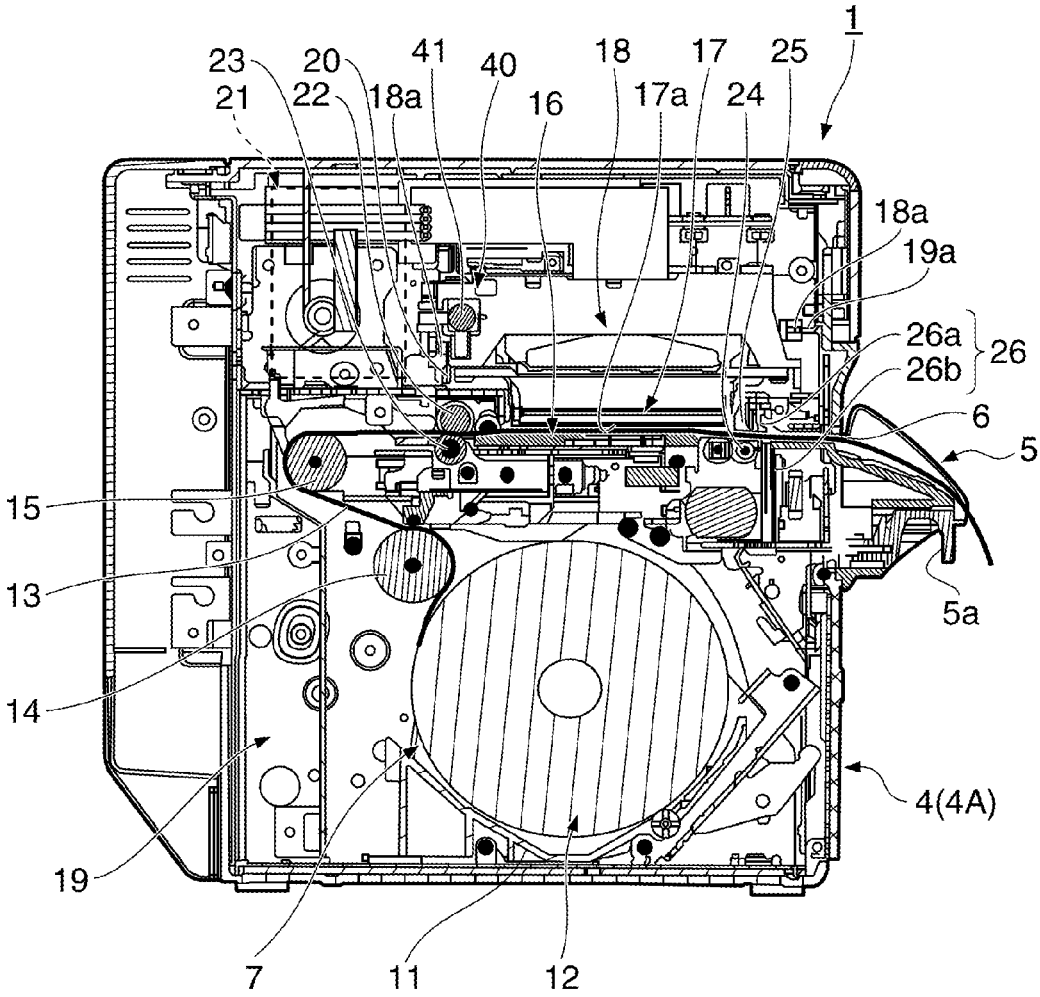
FIG. 3 is a vertical section view showing the internal configuration of the roll paper printer.

FIG. 3 is a vertical section view showing the internal configuration of the roll paper printer 1.

The roll paper compartment 7 has a roll paper tray 11 with an arcuate section that is open to the top, and the roll paper 12 is stored freely rotatably on the roll paper tray 11.

A web of recording paper 13 pulled from the roll paper 12 at the back of the printer is conveyed passed a feed roller 14 and a tension roller 15 disposed behind and above the feed roller 14, and is pulled to the front of the printer from a position above and behind the roll paper compartment 7. The recording paper 13 pulled from the tension roller 15 to the front is pulled to the front over the surface of the platen 16 located directly above the roll paper compartment 7, and is pulled out to the front of the printer from the paper exit 6.

The carriage 18 on which the print head 17 (inkjet head) is mounted is disposed so that the carriage 18 can move reciprocally widthwise to the printer (the main scanning direction perpendicular to the recording paper transportation direction) along the guide shaft 41 of the carriage guide mechanism 40. The guide shaft 41 spans between the left and right side panels of the sheet metal printer frame 19 on the opposite sides of the printer width. The nozzle surface 17*a* of the print head 17 carried on the carriage 18 opposes the top of the platen 16 with a constant gap therebetween.

A timing belt hook 20*a* (see FIG. 4) is attached to the carriage 18 at a position to the back of the printer from where the guide shaft 41 is supported. The timing belt hook 20*a* is affixed to a timing belt 20, which is mounted on pulleys not shown disposed at opposite sides of the printer width. The timing belt 20 is driven by a carriage motor 21, and the carriage 18 travels bidirectionally widthwise to the printer (in the main scanning direction) along the guide shaft 41 by means of the timing belt 20.

A paper feed drive roller 22 is disposed behind the platen 16, and a paper feed follower roller 23 is pressed from below to the paper feed drive roller 22. A paper discharge drive roller 24 is disposed in front of the platen 16, and a paper discharge follower roller 25 is pressed from above to the paper discharge drive roller 24.

The recording paper 13 is conveyed between the paper feed drive roller 22 and paper feed follower roller 23 passed the printing position defined by the top of the platen 16, and is fed between the paper discharge drive roller 24 and paper discharge follower roller 25 to the paper exit 6. The print head 17 that travels bidirectionally widthwise to the printer guided by the carriage guide mechanism 40 prints on the surface of the recording paper 13 passing the printing position. The recording paper 13 fed between the paper discharge drive roller 24 and paper discharge follower roller 25 is cut widthwise by the fixed knife 26*a* and movable knife 26*b* of the recording paper cutter mechanism 26 disposed proximally to the paper exit 6. The portion of the printed recording paper that is cut to a certain length (not shown in the figure) can then be issued as a receipt, for example.

Carriage Guide Mechanism

Figure 4:
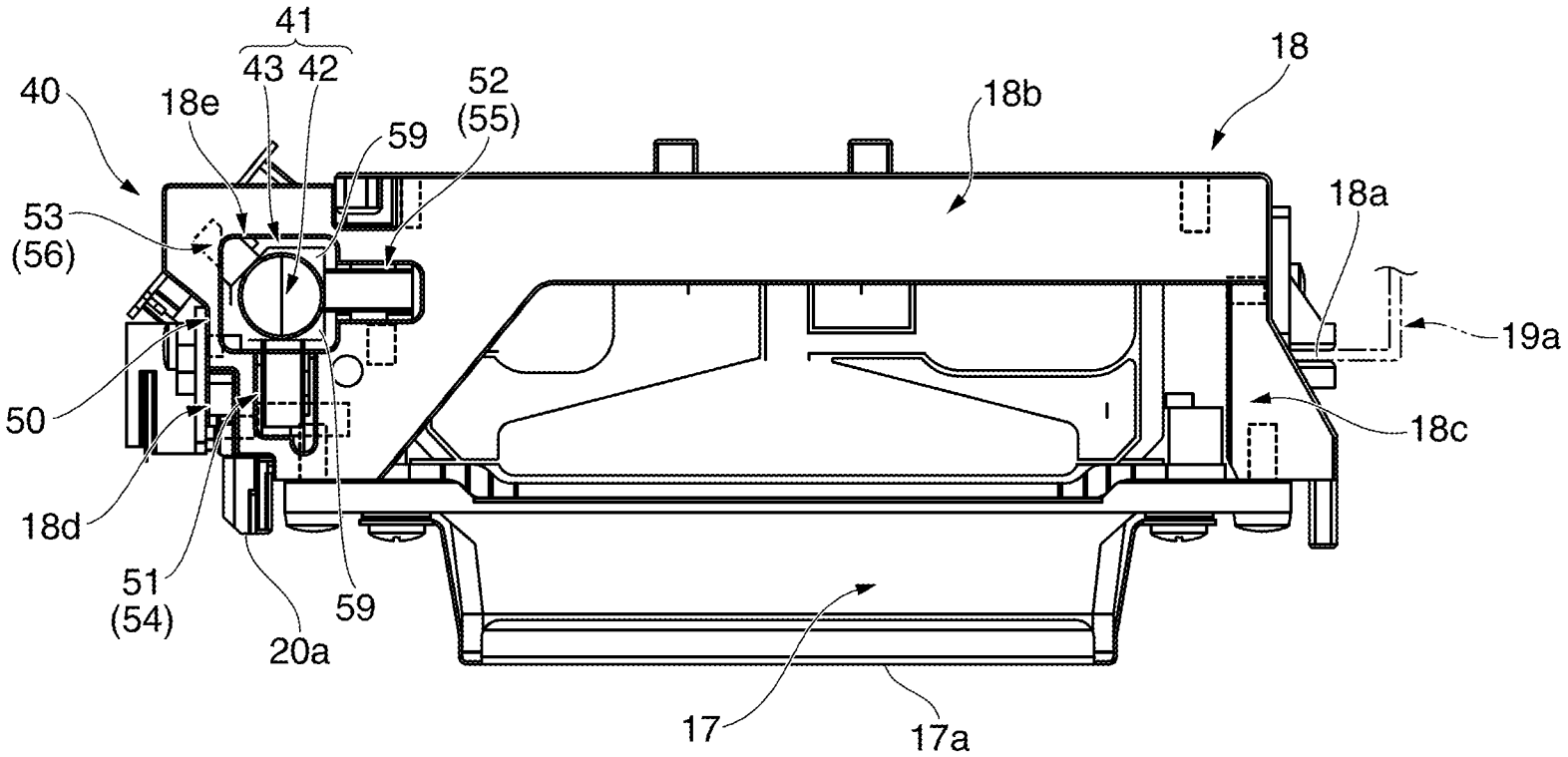
FIG. 4 is a side view showing the inkjet head and carriage guide mechanism
Figure 5:
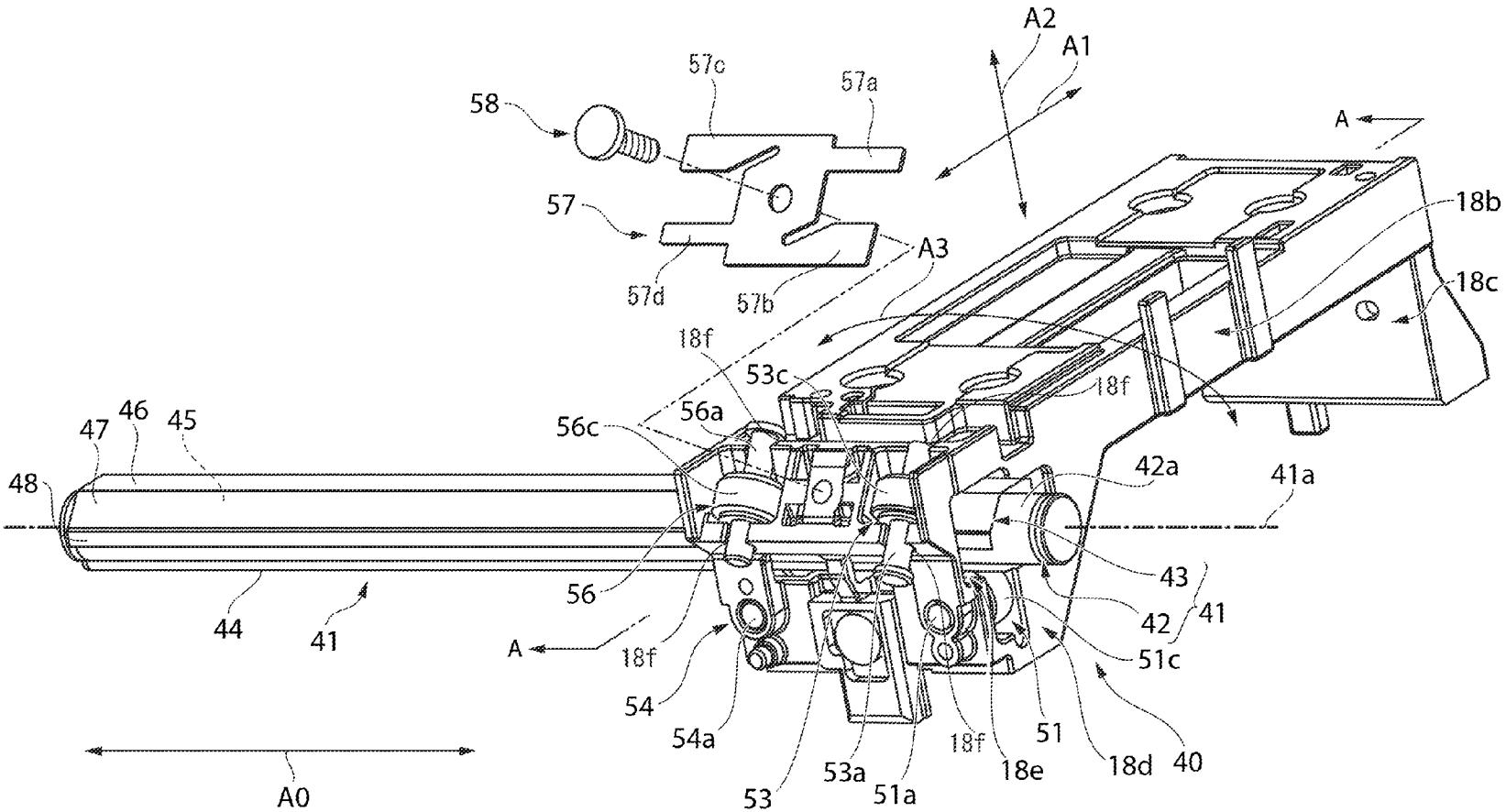
FIG. 5 is an oblique view of the carriage guide mechanism
Figures 6A, 6B:
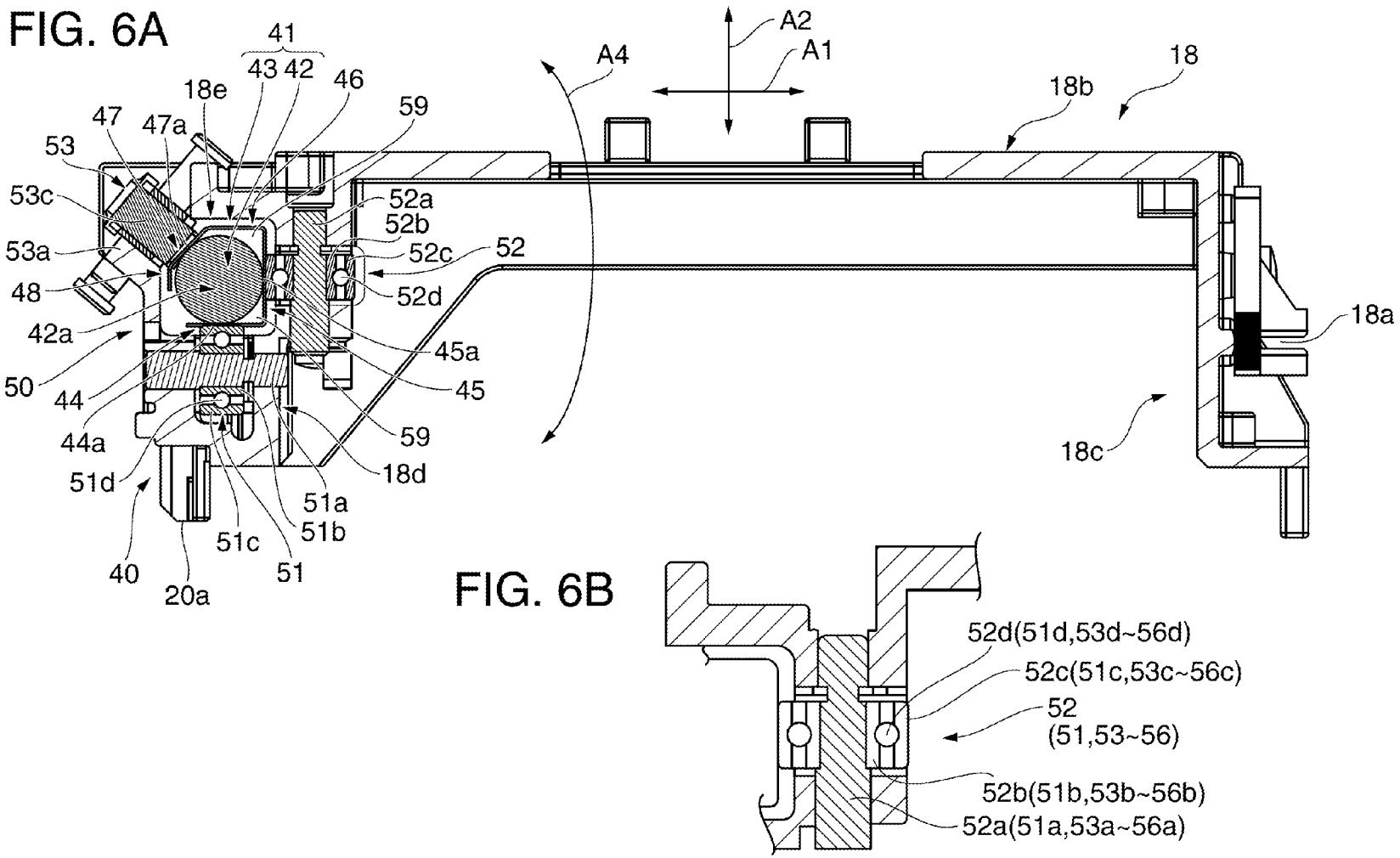
FIG. 6 is a vertical section view of the carriage guide mechanism through line A-A in FIG. 5.

FIG. 4 is a side view of the carriage 18 on which the print head 17 is mounted and the carriage guide mechanism 40. FIG. 5 is an oblique view of the carriage 18 and carriage guide mechanism 40. FIG. 6A and FIG. 6B are a vertical section view and a partially enlarged section view through line A-A in FIG. 5. As shown in these figures, the carriage guide mechanism 40 includes a guide shaft 41 that extends widthwise to the printer (in the main scanning direction) as denoted by arrow A0 in FIG. 5, and a plurality (six in this embodiment of the invention) of rolling bearings 51 to 56 attached to the carriage 18 side. The side of the carriage 18 at the back of the printer is supported by the guide shaft 41 by means of a bearing unit 50 that includes these six rolling bearings 51 to 56.

The carriage guide mechanism 40 also includes a guide channel 18*a* with a rectangular section that is open to the front of the printer at a part of the carriage 18 towards the front of the printer, and a guide rail 19*a* that extends widthwise to the printer and is slidably inserted to the guide channel 18*a*. The guide rail 19*a* is formed on the printer frame 19 side (see FIG. 3). The carriage 18 is thus supported at both the front and back sides of the printer so that the carriage 18 can slide widthwise to the printer on the guide rail 19*a* and guide shaft 41.

The carriage 18 is a plastic molding, for example, and includes a head installation part 18*b* extending in the front-back direction of the printer to which the print head 17 is attached facing down; a side part 18*c* that extends vertically to the printer and is formed at the front end of the head installation part 18*b*; and a back part 18*d* that is formed at the back end of the head installation part 18*b*. The guide channel 18*a* is disposed to the side part 18*c* between a pair of vertical risers that project to the front of the printer. The bearing unit 50 to which the six rolling bearings 51 to 56 are disposed is rendered at the back part 18*d* of the carriage 18.

The guide shaft 41 includes a main guide shaft 42 with a circular section, and a tubular guide plate 43 that is affixed to the main guide shaft 42 so that it surrounds the round outside surface 42*a* of the main guide shaft 42. The guide plate 43 is made of sheet metal, for example, and is formed by bending a metal plate of constant thickness and constant width into a tubular shape. In this embodiment of the invention the guide plate 43 includes a bottom horizontal panel 44 opposing the bottom of the printer; a vertical side panel 45 that is bent perpendicularly up from the bottom horizontal panel 44 at the edge towards the front of the printer; a top horizontal panel 46 that is bent perpendicularly to the back of the printer from the top edge of the bottom horizontal panel 44; an inclined side panel 47 that is bent downward approximately 45 degrees from the back edge of the top horizontal panel 46; and a bent side panel 48 that is bent down from the bottom edge of the inclined side panel 47. A gap is between the bottom edge of the bent side panel 48 and the back edge of the bottom horizontal panel 44.

The bottom horizontal panel 44 extends in the direction of center axis 41*a* of the guide shaft 41. The bottom outside surface of the bottom horizontal panel 44 renders a first outer ring roller surface 44*a* that is flat, and the top inside surface of the bottom horizontal panel 44 contacts the outside surface 42*a* of the main guide shaft 42.

The vertical side panel 45 likewise extends in the direction of the center axis 41*a*, the outside surface renders a second outer ring roller surface 45*a* that is flat, and the inside surface contacts the outside surface 42*a* of the main guide shaft 42.

The inclined side panel 47 likewise extends in the direction of the center axis 41*a*, the outside surface renders a third outer ring roller surface 47*a* that is flat, and the inside surface contacts the outside surface 42*a* of the main guide shaft 42.

The top horizontal panel 46 is disposed with a slight gap to the outside surface 42*a* of the main guide shaft 42.

The guide plate 43 is bent to form the first to third outer ring roller surfaces 44*a*, 45*a*, 47*a* in this example, but four or more outer ring roller surfaces each facing in a different direction may be formed. In addition, the guide shaft 41 is rendered by the round main guide shaft 42 and guide plate 43, but the guide shaft 41 may be rendered from a single member. For example, a solid or hollow center shaft with a polygonal section may be used with the flat outside surfaces thereof used as outer ring roller surfaces.

A shaft through-hole 18*e* with a substantially rectangular section that is slightly larger than the guide shaft 41 described above is also formed at the back part 18*d* of the carriage 18. This shaft through-hole 18*e* extends widthwise to the printer at the back part 18*d*, and the guide shaft 41 is inserted to the shaft through-hole 18*e*. Three rolling bearings, that is, first to third rolling bearings 51 to 53, are assembled at this back part 18*d* at one transverse end of the shaft through-hole 18*e* to enclose the main guide shaft 42 inserted to the shaft through-hole 18*e* from three sides. Another three rolling bearings, that is, fourth to sixth rolling bearings 54 to 56, are assembled at the back part 18*d* at the other transverse end of the shaft through-hole 18*e* left-right symmetrically to the first to third rolling bearings 51 to 53 to enclose the main guide shaft 42 inserted to the shaft through-hole 18*e* from three sides.

The first to sixth rolling bearings 51 to 56 are identically structured, and may be ball bearings, for example. These rolling bearings 51-56 are identically structured, and as shown by the rolling bearing 52 in FIG. 6B, each have an inner ring support shaft 52*a* (51*a*, 53*a*-56*a*) attached to the back part 18*d* of the carriage; an inner ring 52*b* (51*b*, 53*b*-56*b*) affixed coaxially to the inner ring support shaft 52*a*; an outer ring 52*c* (51*c*, 53*c*-56*c*) disposed coaxially around the inner ring 52*b* (51*b*, 53*b*-56*b*); and a plurality of rollers, such as balls 52*d* (51*d*, 53*d*-56*d*), inserted to roll freely in an annular track formed between the inner ring 52*b* and outer ring 52*c*.

The first and fourth rolling bearings 51, 54 are affixed to the back part 18*d* of the carriage with the inner ring support shafts 51*a*, 54*a* extending in the front-back direction of the printer, and the outer rings 51*c*, 54*c* projecting up from the bottom toward the inside of the shaft through-hole 18*e*. The outer rings 51*c*, 54*c* make line contact with the outer ring roller surface 44*a* so that they can roll widthwise to the printer (in the direction of the center axis 41*a*) along the outer ring roller surface 44*a* of the guide plate 43.

The inner ring support shafts 52*a*, 55*a* of the second and fifth rolling bearings 52, 55 are affixed vertically to the printer to the back part 18*d* of the carriage, and the outer rings 52*c*, 55*c* protrude to the front into the shaft through-hole 18*e*. The outer rings 52*c*, 55*c* make line contact with the second outer ring roller surface 45*a* of the guide plate 43 so that the outer rings can roll freely.

As shown in FIG. 5 and FIG. 6, the third and sixth rolling bearings 53, 56 are attached to the back part 18*d* by a flat spring 57 (urging member) so that the inner ring support shafts 53*a*, 56*a* are inclined 45 degrees to the vertical and the front-back direction of the printer. More specifically, as will be understood from FIG. 5, a pair of shaft receiving channels 18*f* are rendered in the back part 18*d* to receive the ends of the inner ring support shafts 53*a*, 56*a*. Four spring ends 57*a* to 57*d* of the flat spring 57 contact the inner ring support shafts 53*a*, 56*a* held in the shaft receiving channels 18*f* so that the support shafts do not escape from the shaft receiving channels 18*f*.

The flat spring 57 is affixed by a screw 58 to the back part 18*d*. The pressure of the flat spring 57 on the inner ring support shafts 53*a*, 56*a* can be adjusted by adjusting how far the screw 58 is screwed in. The urging force of the flat spring 57 pushes the outer rings 53*c*, 56*c* of the third, sixth rolling bearings 53, 56 to make line contact with the third outer ring roller surface 47*a* of the guide plate 43.

In addition, by adjusting the depth of the screw 58 to adjust the urging force on the inner ring support shafts 53*a*, 56*a*, the pressure of the third and sixth rolling bearings 53, 56 on the third outer ring roller surface 47*a* can also be adjusted.

The force of the flat spring 57 also urges the guide plate 43 to the other side, that is, toward the first, second, fourth, and fifth rolling bearings 51, 52, 54, 55. The first outer ring roller surface 44*a* and the second outer ring roller surface 45*a* are also held in contact with the outer rings 51*d*, 52*d*, 54*d*, 55*d* of the first, second, fourth, and fifth rolling bearings 51, 52, 54, 55.

Operating Effect of the Carriage Guide Mechanism

The carriage guide mechanism 40 supports the carriage 18 with three rolling bearings 51-53, 54-56 supporting the guide shaft 41 from three directions at both transverse ends of the back part 18*d*. The outer rings 51*c*-56*c* of the rolling bearings 51-56 make line contact with the first to third outer ring roller surfaces 44*a*, 45*a*, 47*a*. Because the third and sixth rolling bearings 53 and 56 are urged diagonally by the urging force of a flat spring 57, the first, second, fourth, and fifth rolling bearings 51, 52, 54, 55 contact the first and second outer ring roller surfaces 44*a*, 45*a* with no gap therebetween.

The bearing unit 50 of the carriage 18 thus holds the guide shaft 41 from three directions by means of three rolling bearings 51-53, 54-56 at each end of the guide shaft 41. Play and vibration both vertically and in the front-back direction of the printer (directions A1 and A2 in FIG. 5 and FIG. 6) can therefore be prevented when the carriage 18 moves, and play and vibration at the guide shaft 41 side of the carriage 18 transversally to the printer (direction A3 in FIG. 5) can also be prevented. In addition, because the outer rings 51*c*-56*c* of the rolling bearings 51-56 contact the first to third outer ring roller surfaces 44*a*, 45*a*, 47*a* at lines facing different directions, play and vibration of the carriage around the center axis 41*a* of the guide shaft 41 (direction A4 in FIG. 6) can also be reliably prevented.

As a result, the carriage guide mechanism 40 can move the carriage 18 bidirectionally widthwise to the printer with no play or vibration. The carriage guide mechanism 40 can therefore also prevent problems caused by carriage 18 chatter or vibration, such as variation in the gap between the nozzle surface 17*a* of the print head 17 and the platen 16, and change in the angle of the nozzle surface 17*a* to the platen, and can thereby maintain the desired print quality.

As also described above, the guide shaft 41 in this embodiment of the invention includes a main guide shaft 42 with a round section, and a tubular guide plate 43 that surrounds the main guide shaft 42. As a result, a gap 59 extending widthwise to the printer is formed around the main guide shaft 42 as shown in FIG. 4 and FIG. 6 between the round outside surface of the main guide shaft 42 and the inside surface of the guide plate 43. This gap can be used to hold grease. The grease held thereinside can flow to the outside from a grease supply channel formed in the curved part of the guide plate 43 to lubricate the wear parts of the bearing unit 50.

As described above, the bearing unit 50 of the carriage 18 includes six rolling bearings 51 to 56, and supports the guide shaft 41 by means of three rolling bearings 51 to 53 and 54 to 56 each at both ends thereof in the main scanning direction. Alternatively, the bearing unit 50 of the carriage 18 may be rendered with five rolling bearings, such as rolling bearings 51-55. In this configuration, two rolling bearings 51, 52 and rolling bearings 54, 55 are located at each end in the main scanning direction. The remaining one rolling bearing 53 is disposed to the carriage 18 in the center of the main scanning direction opposite the third outer ring roller surface 47*a*, and is urged by a flat spring to the third outer ring roller surface 47*a*. As described above, this configuration can also prevent play and vibration when the carriage 18 moves.

The embodiment described above uses six rolling bearings, but only three rolling bearings may be used if the guide shaft can be held from three directions. For example, in a configuration with a small, lightweight carriage, carriage play and vibration can be limited to a level that is no problem for practical use by using three rolling bearings.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A carriage guide mechanism that guides a carriage carrying a printhead in a main scanning direction perpendicular to the recording paper transportation direction, comprising:

a guide shaft that extends in the main scanning direction, wherein the guide shaft has a main guide shaft that is round in section and a tubular guide panel that is disposed to the main guide shaft so that the guide panel surrounds a round outside surface of the main guide shaft, wherein a gap between the outside surface of the main guide shaft and an inside surface of the guide panel is a grease reservoir; and at least three rolling bearings that support the carriage freely movably on the guide shaft;

wherein at least three outer ring roller surfaces that extend in the direction of the center axis of the guide shaft are formed to the outside surface of the guide shaft, each of the outer ring roller surfaces facing a different direction, and at least three flat parts where the outer ring roller surfaces are formed are rendered in the outside surface of the guide panel, and the inside surface of the guide panel at the flat parts contacts the round outside surface of the main guide shaft;

the number of outer ring roller surfaces and the number of rolling bearings are set so that at least one rolling bearing is opposite each outer ring roller surface, each rolling bearing includes an inner ring support shaft attached to the carriage, an inner ring affixed coaxially to the inner ring support shaft, an outer ring coaxially disposed around the inner ring, and a plurality of rollers inserted to roll freely in an annular track formed between the inner ring and the outer ring, and the outer ring of each rolling bearing contacts the outer ring roller surface so that the rolling bearings can roll axially to the guide shaft along the outer ring roller surface opposing the rolling bearing, wherein the outer ring roller surface includes:

a first outer ring roller surface, a second outer ring roller surface perpendicular to the first outer ring roller surface, and a third outer ring roller surface that is inclined at an angle of less than 90 degrees to the first and second outer ring roller surfaces, wherein the first, second and third outer ring roller surfaces extend in the direction of a center of the guide shaft; and wherein the outer ring of the rolling bearing opposite the third outer ring roller surface is urged to the third outer ring roller surface by an urging force applied to the inner ring support shaft of the third rolling bearing by a flat spring.

2. The carriage guide mechanism described in claim 1, wherein:

one rolling bearing opposite the first outer ring roller surface, and one rolling bearing opposite the second outer ring roller surface, are disposed at each end of the carriage in the main scanning direction.

3. A printer comprising the carriage guide mechanism described in claim 1, the printhead and the carriage.

* * * * *